United States Patent [19]

Fujii et al.

[11] Patent Number: 5,014,672

[45] Date of Patent: May 14, 1991

[54] FUEL SUPPLY CONTROLLER FOR AN INTERNAL COMBUSTION ENGINE

[75] Inventors: Takaaki Fujii; Masahiko Abe; Akio Kobayashi, all of Saitama, Japan

[73] Assignee: Honda Giken Kogyo Kabushiki Kaisha, Tokyo, Japan

[21] Appl. No.: 542,807

[22] Filed: Jun. 25, 1990

Related U.S. Application Data

[63] Continuation of Ser. No. 253,783, Oct. 5, 1988, abandoned.

[30] Foreign Application Priority Data

| | | | |
|---|---|---|---|
| Oct. 7, 1987 | [JP] | Japan | 62-253980 |
| Nov. 5, 1987 | [JP] | Japan | 62-280132 |
| Nov. 5, 1987 | [JP] | Japan | 62-280133 |
| Nov. 9, 1987 | [JP] | Japan | 62-283857 |

[51] Int. Cl.[5] ..... F02M 51/00

[52] U.S. Cl. ..... 123/492; 123/489

[58] Field of Search ..... 123/492, 493, 491, 478, 123/480; 364/431.07, 442

[56] References Cited

U.S. PATENT DOCUMENTS

| | | | |
|---|---|---|---|
| 4,240,383 | 12/1980 | Horbelt et al. . | |
| 4,401,087 | 8/1983 | Ikeura | 123/492 |
| 4,408,588 | 10/1983 | Mausner | 123/489 |
| 4,434,769 | 3/1984 | Otobe et al. | 123/492 |
| 4,437,446 | 3/1984 | Isomura et al. | 123/492 |
| 4,440,136 | 4/1984 | Denz et al. | 123/491 |
| 4,463,730 | 8/1984 | Kishi | 123/492 |
| 4,469,073 | 9/1984 | Kobayashi et al. | 123/492 |
| 4,487,190 | 12/1984 | Isobe | 123/492 |
| 4,490,792 | 12/1984 | Deutsch et al. | 364/431.07 |

*Primary Examiner*—Raymond A. Nelli
*Attorney, Agent, or Firm*—Lyon & Lyon

[57] ABSTRACT

A fuel supply controller for an internal combustion engine includes an acceleration mode detector, an incremental fuel supply rate calculator, and a fuel supplier. The controller sets a smaller incremental fuel supply rate with increasing engine speed to prevent excessive fuel supply to the engine during acceleration. A fuel supply corrector, a correction inhibitor, and a correction inhibitor canceller are provided for improved acceleration performance regardless of the mode of acceleration. An acceleration mode discriminator and an incremental fuel rate supplier provide proper fuel control even with increasing acceleration. The controller can use first and second control maps for controlling fuel supply. A map discriminator provides for a smooth changeover between maps.

5 Claims, 10 Drawing Sheets

FIG. 1.
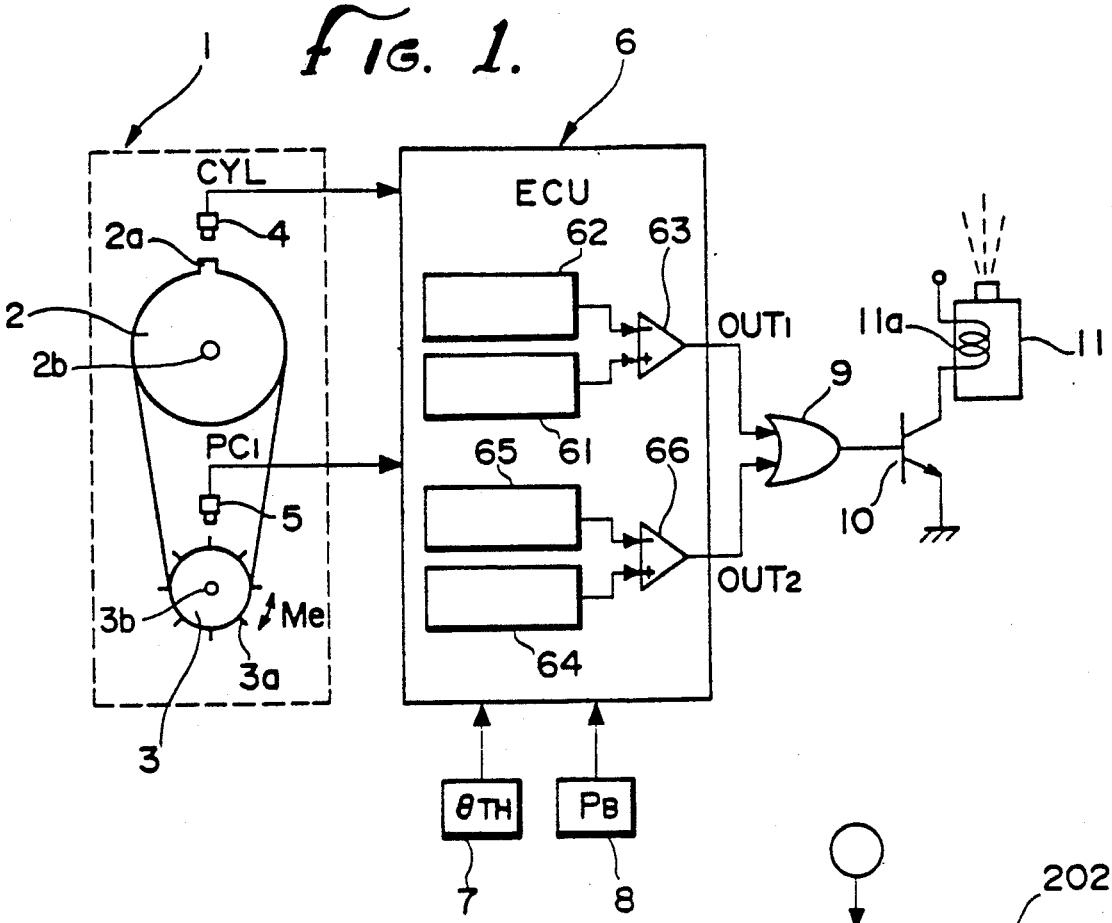
FIG. 2A.
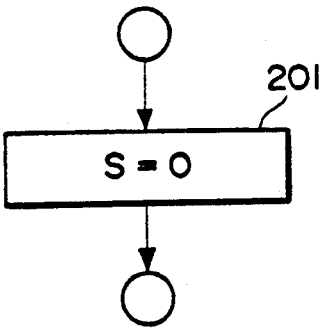
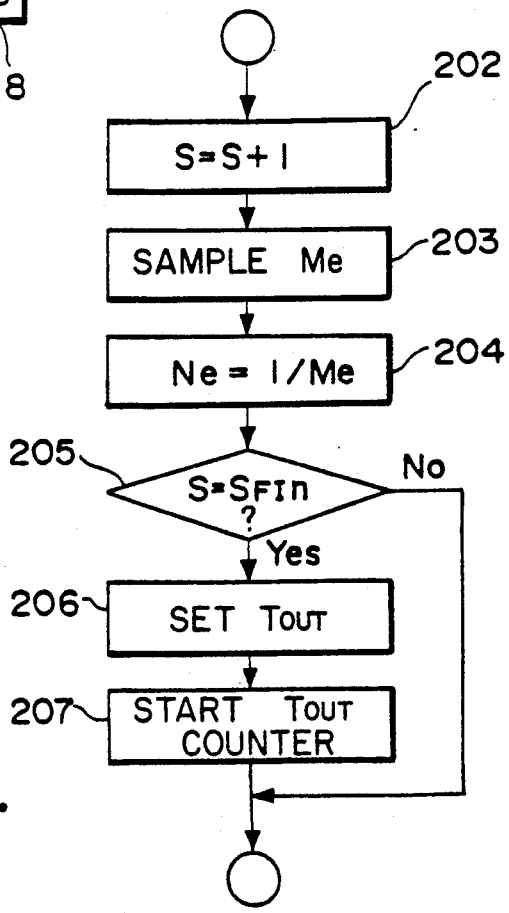
FIG. 2B.

FUEL SUPPLY CONTROLLER FOR AN INTERNAL COMBUSTION ENGINE

This application is a continuation of application Ser. No. 253,783, filed Oct. 5, 1988 now abandoned.

BACKGROUND OF THE INVENTION

The invention relates to a fuel supply controller for an internal-combustion engine and, more specifically to a fuel supply controller capable of properly controlling the fuel supply rate in accelerating the engine.

Japanese Patent Document No. 54-134227 discloses a fuel supply controller for an internal-combustion engine. This known fuel supply controller supplies fuel to an engine at a basic fuel supply rate corresponding to the operating mode of the engine. It implements accelerating incremental fuel supply correction to enhance engine output for desired accelerating characteristics, when the engine is in a predetermined mode of acceleration, for example, when the variation of throttle valve position exceeds a fixed value. However, a disadvantage of this known fuel supply controller is that fuel is supplied to the engine at an excessively high fuel supply rate in accelerating the engine causing deterioration of engine performance and specific fuel consumption. In addition, the engine output decreases when fuel supplied thereto for each combustion cycle exceeds a maximum fuel supply rate. Furthermore, the higher the engine speed, the higher is the basic fuel supply rate to generate a higher engine output. On the other hand, since this known fuel supply controller is designed to set an accelerating incremental fuel supply rate regardless of the engine speed, it possible that the sum of the basic fuel supply rate and the accelerating incremental fuel supply rate will exceed the maximum fuel supply rate. In this event, fuel is supplied to the engine at such an excessively high fuel supply rate that output is reduced.

The fuel supply controller of Japanese Patent Document No. 54-134227 increases fuel supply in accelerating the engine, and then inhibits accelerating incremental fuel supply correction for a fixed period of time after accelerating incremental fuel supply correction has been implemented.

Since this known fuel supply controller inhibits further accelerating incremental fuel supply correction indiscriminately for a fixed period of time once accelerating incremental fuel supply correction is implemented, the fuel supply control operation of the fuel supply controller is unaffected by external disturbances such as noise. However, in some cases, such inhibition of further accelerating incremental fuel supply correction hinders the accelerating performance of the engine. In the case of a vehicle in which rapid acceleration performance is essential, such as a motorcycle, it is impossible with this known controller to control the fuel supply properly for rapid acceleration. The fuel supply (at an appropriate fuel supply rate) is delayed when accelerating operation is performed again before the elapse of the accelerating incremental fuel supply correction inhibiting period. This occurs because increasing the fuel supply rate is inhibited indiscriminately during the accelerating incremental fuel supply correction inhibiting period.

With respect to motorcycles in particular, it is possible to immediately close the throttle valve forcibly by turning the throttle grip. In contrast the throttle valve of an automobile is operated by stepping on the accelerator pedal and releasing the accelerating pedal. Hence, the throttle valve returns to the closed position spontaneously, in a predetermined time after the accelerator pedal has been released. Accordingly, the throttle valve of a motorcycle can immediately be closed after accelerating and can immediately be opened again, one of the features of a motorcycle. However, if accelerating incremental fuel supply correction is inhibited indiscriminately once accelerating fuel incremental supply correction has been implemented, it is impossible to take full advantage of this motorcycle feature.

Japanese Patent Document No. 61-15261 discloses a fuel supply controller for improving the accelerating performance of an internal combustion engine. This known fuel supply controller calculates a fuel injection rate (i.e., a fuel injection period Ti) at which fuel is to be injected by the fuel injection valve, by using a matrix memory ($P_B$-NE map). The matrix memory is specified by engine speed Ne and intake manifold pressure $P_B$ as parameters in the normal operating mode while the engine is operating in a low load range. With the engine operating in a high load range, this controller also calculates a fuel injection rate (a basic fuel injection period Ti) at which fuel is to be injected by the fuel injection valve, by using a matrix memory ($\Theta_{TH}$-Ne map) specified by engine speed Ne and throttle valve position $\Theta_{TH}$ as parameters. However, a disadvantage associated with this known fuel supply controller is that immediate accelerating incremental fuel supply operation using the $P_B$-Ne map is impossible when an accelerating incremental fuel supply rate is calculated for an accelerating mode of the engine, in a range in which fuel injection rate is calculated by the PB-Ne map (such a control range will be referred to as a "$P_B$-Ne control range" hereinafter.) This results because the detection of the intake manifold pressure $P_B$ is delayed by the effect of the length of the pipe connecting an intake manifold pressure sensor to the intake or suction pipe. Hence the detection of the intake manifold pressure $P_B$ is unable to follow the variable intake manifold pressure $P_B$ up without delay. On the other hand, when the accelerating incremental fuel supply rate is calculated in a control mode for a range in which fuel injection rate is calculated by using the $\Theta_{TH}$-Ne map (such a control range is referred to as "$\Theta_{TH}$-Ne control range" hereinafter), throttle valve position can be detected without delay. Accordingly, the accelerating incremental fuel supply rate varies discontinuously when the $P_B$-Ne map is changed for the $\Theta_{TH}$-Ne map as the engine is accelerated. Consequently, the engine does not operate smoothly.

The fuel supply of controller of the previously described Japanese Patent Document No. 54-134227 also detects the operating mode of the engine through the detection of the flow rate of air flowing through the intake or suction pipe, which flow rate corresponds to the degree of throttle valve opening. When the engine is in an accelerating mode, the controller increases the pulse width of fuel injection pulses for driving the fuel injection valve to increase the fuel supply rate.

However, in this known fuel supply controller, the increment of the pulse width of fuel injection pulses is set for a condition in which the throttle valve is in the initial stage of opening. The subsequent continuous increase of the rate of variation of the degree of throttle valve opening entailing increase in the rate of acceleration of the engine is not addressed. Therefore this known fuel supply controller has a disadvantage in that fuel supply control operation is delayed and the fuel supply rate cannot immediately be increased for a continuous acceleration. That is, since this known fuel supply controller decides that the engine is in an accelerating mode when the air flow rate (or the rate of variation of degree of throttle valve opening (acceleration) exceeds a single predetermined value) and performs accelerating incremental fuel supply control only once in a fixed time period for each cylinder of the engine, further accelerating incremental fuel supply control is not performed, even if the air flow rate or the rate of variation of the degree of throttle valve opening continues to increase. Consequently, fuel is not supplied at a fuel supply rate necessary for the accelerating mode. Thus, the acceleration performance of the engine is degraded. This is especially conspicuous with a motorcycle, because the degree of throttle valve opening of such an engine can forcibly be changed by the driver.

SUMMARY OF THE INVENTION

The present invention is directed towards overcoming the above-described disadvantages.

To this end, a fuel supply controller for an internal-combustion engine comprises an accelerating mode detector for detecting the mode of acceleration of the internal-combustion engine; accelerating incremental fuel supply rate setting means for setting an accelerating incremental fuel supply rate; and a fuel supplier for supplying fuel to the internal-combustion engine at a fuel supply rate at least according to the output of the accelerating incremental fuel supply rate setting means. The accelerating incremental fuel supply rate setting means sets a small accelerating incremental fuel supply rate for higher engine speed. Thus, an excessively high fuel supply rate during acceleration is avoided.

To this end, the present invention further provides a fuel supply controller for an internal-combustion engine comprising an accelerating incremental fuel supply corrector for incremental fuel supply correction in accelerating the engine. An accelerating incremental fuel supply correction inhibitor is provided for inhibiting accelerating incremental fuel supply correction after a predetermined period from the operation of the accelerating incremental fuel supply corrector. The fuel supply controller further comprises an inhibition canceller for cancelling the inhibition of accelerating incremental fuel supply correction even before the elapse of the predetermined period, when the degree of opening of the throttle valve is decreased after accelerating the engine.

To provide fuel supply control without delay after switching from the PB-Ne map to the $\Theta_{TH}$ map, the present invention selectively uses a first map specified by the intake manifold pressure and engine speed of the internal-combustion engine as parameters, and a second map specified by the throttle valve position and the engine speed as parameters. A map discriminator for discriminating the selected map among the first and second maps is provided. In addition, an accelerating incremental fuel supplier is included for increasing fuel supply rate while the internal-combustion engine is in a predetermined accelerating mode only when the map discriminator identifies the selected map as the first map.

The present invention further provides a fuel supply controller comprising an accelerating mode discriminator for discriminating the accelerating mode. In addition, an accelerating incremental fuel supplier supplies fuel at an accelerating incremental fuel supply rate according to the output of the accelerating mode discriminator. The accelerating incremental fuel supply rate is increased when the acceleration level rises during fuel supply at the accelerating incremental fuel supply rate.

Accordingly, it is an object of the present invention to provide a fuel supply controller for an internal-combustion engine, capable of properly controlling the accelerating incremental fuel supply rate over a wide range of engine speed so as to improve the performance and specific fuel consumption of the engine.

It is also an object of the present invention to provide a fuel supply controller capable of improving the rapid acceleration performance of the engine and controlling the fuel supply system without delay for rapid acceleration.

It is a further object of the present invention to provide a fuel supply controller capable of controlling accelerating incremental fuel supply without delay on the basis of the $P_B$-Ne map and immediatelY after the $P_B$-Ne map has been changed for the $\Theta_{TH}$ map.

It is a further object of the present invention to provide a fuel supply controller capable of properly achieving accelerating incremental fuel supply control even in rapid acceleration in which the rate of acceleration of the engine is increasing.

BRIEF DESCRIPTION OF THE DRAWINGS

In the drawings, wherein similar reference characters denote similar elements through the several views:

FIG. 1 is a schematic block diagram of a fuel controller according to the present invention;

FIG. 2 is a flowchart of subroutines for synchronous fuel injection;

Figure 3:
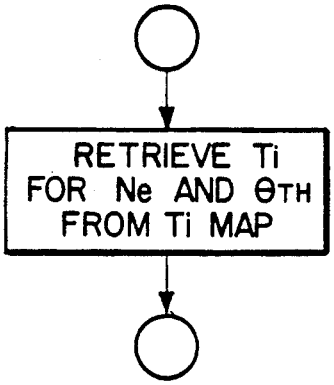
FIG. 3 is a flowchart of a subroutine for setting a basic fuel injection time Ti for setting a fuel injection time $T_{OUT}$.

Turning now to the appended drawings, as shown in FIG. 1, an internal-combustion engine 1, for example, a four-cylinder or six-cylinder internal-combustion engine (typically a motorcycle engine) includes a radial projection 2*a* at a predetermined position on the circumference of a camshaft 2 of the engine 1. A plurality of radial projections 3*a*, for example, eight radial projections (which represent stages), are arranged at equally-spaced angular intervals on the circumference of a crankshaft 3.

A cylinder discriminating sensor 4 (hereinafter referred to as "CYL sensor") and a crank angle sensor 5 (hereinafter referred to as "$PC_1$ sensor") are disposed respectively opposite the circular path of the projection 2*a* and the circular path of the projections 3*a*. The sensors 4 and 5 are, for example, pickup coils. The CYL sensor 4 generates a cylinder discrimination signaling pulse (hereinafter referred to as "CYL pulse") every time the projection 2*a* passes the CYL sensor 4 (head cam position) as the camshaft 2 rotates, and the $PC_1$ sensor 5 generates a crank angle signalling pulse (hereinafter referred to as "$PC_1$ pulse") every time each projection 3*a* passes the $PC_1$ sensor 5 as the crankshaft 3 rotates. The sensors 4 and 5 are connected electrically to an electronic control unit (hereinafter abbreviated to "ECU") 6 which receives the CYL pulse and the $PC_1$ pulse into the ECU 6.

Also electrically connected to the ECU 6 are a throttle valve position ($\Theta_{TH}$) sensor 7 and an intake manifold pressure ($P_B$) sensor 8. The throttle valve position sensor 7 is associated with the throttle valve (not shown) provided within the intake manifold (not shown) of the engine 1 to detect the position $\Theta_{TH}$ of the throttle valve. The intake manifold pressure senor 8 is provided within the intake manifold at a position after or downstream of the throttle valve to detect the intake manifold pressure $P_B$. The throttle valve position sensor 7 and the intake manifold pressure sensor 8 provide detection signals to the ECU 6.

The ECU 6 calculates injection time $T_{OUT}$ according to a control program described below on the basis of input signals provided to the ECU 6 by the sensors. The ECU 6 calculates accelerating incremental fuel supply time $Ti_A$ when it determines that the engine 1 is in a predetermined mode of acceleration. In this embodiment, the ECU 6 includes basic fuel supply rate setting means, accelerating mode detecting means, and the accelerating incremental fuel supply rate setting means.

The ECU 6 has a $T_{OUT}$ setting circuit 61 and a $T_{OUT}$ counter 62. The $T_{OUT}$ setting circuit 61 sets the calculated injection time $T_{OUT}$, and the $T_{OUT}$ counter 62 starts operation upon the setting of the injection time $T_{OUT}$. The $T_{OUT}$ setting circuit 61 and the $T_{OUT}$ counter 62 are connected to the input terminals of a first comparator 63. The first comparator 63 generates a HIGH signal (hereinafter referred to as "$OUT_1$ signal") continuously until the count counted by the $T_{OUT}$ counter 62 coincides with the injection time $T_{OUT}$ set by the $T_{OUT}$ setting circuit 61, namely, for the time $T_{OUT}$.

The ECU 6 further has a $Ti_A$ setting circuit 64 which is similar to the TOUT setting circuit 61, a $Ti_A$ counter 65, and a second comparator 66. The $Ti_A$ setting circuit 64 sets the accelerating incremental fuel supply time $Ti_A$ calculated by the ECU 6. The $Ti_A$ counter 65 counts the accelerating incremental fuel supply time $Ti_A$, and the second comparator 66 generates a HIGH signal hereinafter referred to as "$OUT_2$ signal") continuously for the time $Ti_A$.

The respective output terminals of the first comparator 63 and the second comparator 66 are connected to the input terminals of an OR gate circuit 9 provided for each cylinder. The output terminal of the OR circuit 9 is connected to the base of a transistor 10, which in turn is connected to the coil 11*a* of a fuel injection valve (fuel supply means) 11 (a transistor 10 and an injection valve 11 are provided for each cylinder). While the coil 11*a* of the injection valve 11 is energized, namely, while at least the $OUT_1$ signal is provided by the second comparator 66, the corresponding fuel injection valve 11 is opened to supply fuel to the corresponding cylinder (not shown) of the engine 1.

The operation of the fuel supply controller is set forth in FIGS. 2(*a*) and 2(*b*) which show subroutines for controlling fuel injection synchronized with the $PC_1$ pulse (hereinafter referred to as "synchronized fuel injection"). The subroutine of FIG. 2(*a*) is executed every time the CYL pulse is generated, and the subroutine of FIG. 2(*b*) is executed every time the $PC_1$ pulse is generated.

Referring to FIG. 2(*a*), a stage counter (described below) is reset in step 201 to clear the count S. That is, the count S is cleared to initialize the stage counter every time the CYL pulse is generated.

Referring to FIG. 2(*b*), the count S of the stage counter is increased by an increment of "1" in step 202. Thus, the count S of the stage counter indicates the frequency of the $PC_1$ pulses generated after the CYL pulse has been generated. A time interval Me between the two successive $PC_1$ pulses is read in step 203, and then engine speed Ne is calculated from the reciprocal of the time internal Me in step 204.

In step 205, a check is made to determine whether or not the count S of the stage counter has increased to one predetermined value $S_{FIn}$ among a plurality of predetermined valves $S_{FIn}$ respectively for the cylinders, to determine whether or not this loop coincides with fuel injection timing. When the loop corresponds to a fuel injection timing, this step selects the relevant fuel injection valve 11 among the fuel injection valves. The predetermined values $S_{FIn}$ are set respectively for the cylinders so that fuel is injected into each cylinder at a predetermined fuel injection timing, e.g., at a predetermined crank angle, for example, a crank angle before the top dead center (TDC) before the start of the intake or suction stroke of the cylinder.

When the decision in step 205 is NO, that is, when S is not equal to $S_{FIn}$, none of the cylinders is in a state for fuel injection and the program is ended. When the decision in step 205 is YES, namely, when $S=S_{FIn}$, the $T_{OUT}$ setting circuit 61 is set for the injection time $T_{OUT}$ in step 206 and, at the same time, the $T_{OUT}$ counter 62 is started in step 207 to inject fuel from the corresponding fuel injection valve 11 for the fuel injection time $T_{OUT}$ (synchronized fuel injection), and then the program is ended. The fuel injection time $T_{OUT}$, for example, is determined by correcting a basic fuel injection time Ti retrieved from a Ti map stored beforehand in the ECU 6. This is done by executing a subroutine shown in FIG. 3 on the basis of parameters, such as an engine speed Ne and a throttle position $\Theta_{TH}$, representing the operating condition of the engine.

Figure 4:
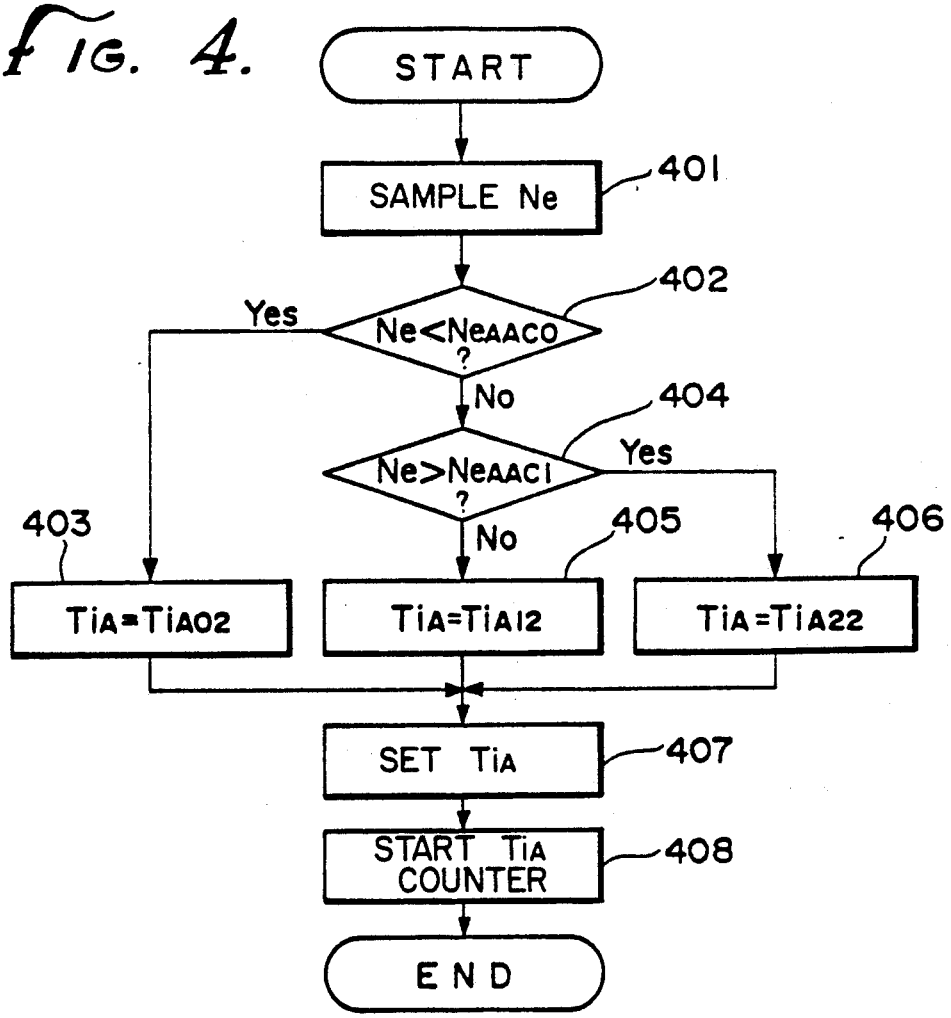
FIG. 4 is a flowchart of a subroutine for controlling asynchronous fuel injection.

When the variation $\Delta\Theta_{TH}$ of throttle valve position exceeds a predetermined value, a subroutine for controlling fuel injections is executed as shown in FIG. 4. This subroutine (hereinafter referred to as asynchronous fuel injection) is executed asynchronously with the generation of the $PC_1$ pulses.

In step 401, engine speed Ne is sampled. The engine speed Ne is sampled immediately before the detection of a predetermined mode of acceleration, namely, immediately before the variation $\Delta\Theta_{TH}$ of throttle valve position exceeds the predetermined value.

In step 402 a check is made to decide whether or not the engine speed Ne is lower than a predetermined first engine speed $Ne_{AACO}$, for example, 1250 rpm. When the decision in step 402 is YES, i.e., when $Ne < Ne_{AACO}$, a predetermined time $Ti_{A02}$, for example, 8 msec, is set as an accelerating incremental fuel supply time $Ti_A$ in step 403, and then the routine goes to step 407.

Figure 5:
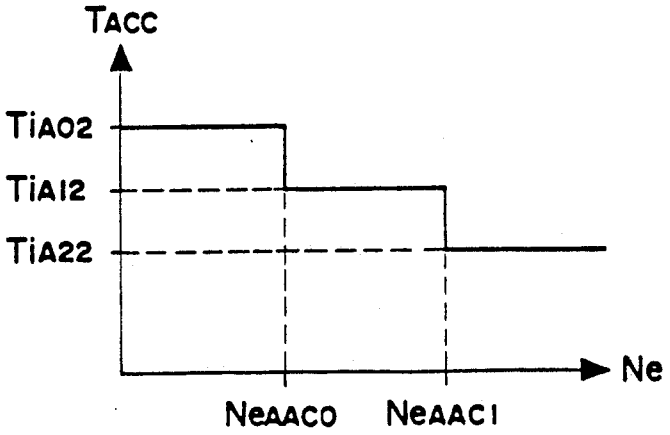
FIG. 5 is a diagram showing the relation between engine speed Ne and accelerating incremental fuel supply time $Ti_A$.

When the decision in step 402 is NO, i.e., when $Ne \geqq Ne_{AACO}$, a check is made in step 404 to see whether or not the engine speed Ne is higher than a predetermined second engine speed $Ne_{AAC1}$, for example, 1750 rpm, which is higher than the first engine speed NeAACO. When the decision in step 404 is NO, that is, when $Ne_{AACO} \leqq Ne \leqq Ne_{AAC1}$, a predetermined second time $Ti_{A12}$, is set as the accelerating incremental fuel supply time $Ti_A$ in step 405. When the decision in step 404 is YES, namely, when $Ne > Ne_{AAC1}$, a predetermined third time $Ti_{A22}$, is set as the accelerating incremental fuel supply time $Ti_A$ in step 406 (FIG. 5), and then the routine goes to step 407.

In step 407, the $Ti_A$ counter 65 is set for the accelerating incremental fuel supply time $Ti_A$ determined in step 403, 405 or 406 and, at the same time, the $Ti_A$ counter 65 is started in step 408 to operate the fuel injection valve 11 for asynchronous fuel injection. Then the program is ended.

Thus, when the engine is in a predetermined mode of acceleration, this subroutine is executed to set a smaller accelerating incremental fuel supply time $Ti_A$ for a higher engine speed Ne. The logical sum of synchronous fuel injection controlled by the subroutine of FIG. 2 and asynchronous fuel injection based on the set $Ti_A$ is then performed. Therefore, fuel is never supplied at fuel supply rate exceeding the maximum fuel supply rate even when the engine is operating in a high speed range. Accordingly, fuel can effectively be supplied to the engine at fuel supply rates which enhances the engine output over a wide engine speed range.

As is apparent from the foregoing description, in the present fuel supply controller, the accelerating incremental fuel supply rate setting means sets a lower accelerating incremental fuel supply rate for a higher engine speed, so that fuel supply rate in an acceleration mode can properly be controlled. Consequently, the performance and specific fuel consumption of the engine are improved.

Figure 6:
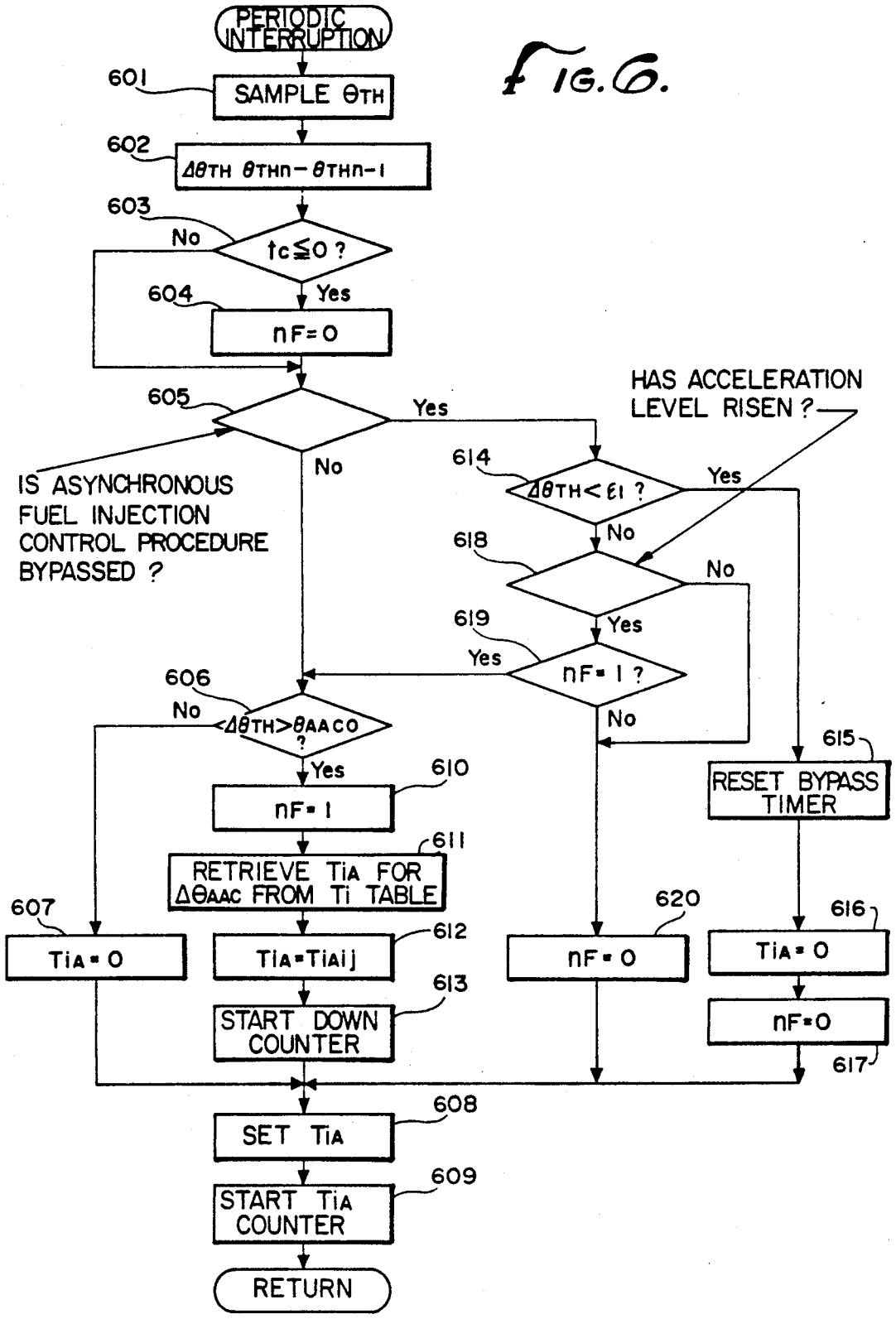
FIG. 6 is a flowchart of a second embodiment for accelerating incremental fuel supply correction through asynchronous fuel injection, inhibiting accelerating incremental fuel supply correction, and cancelling the inhibition of accelerating incremental fuel supply correction.

FIG. 6 is a flowchart showing a subroutine for controlling accelerating incremental fuel supply correction to be implemented when the engine 1 is in a predetermined accelerating state. Accelerating incremental fuel supply inhibition for a predetermined period after accelerating incremental fuel supply correction, and inhibition cancellation under predetermined conditions are also shown. This subroutine is executed asynchronously with the generation of the $PC_1$ pulses. Each step, such as the detection of variation in throttle valve position, is executed periodically in a periodic interruption mode. Fuel injection controlled by the subroutine of FIG. 6 will be referred to as asynchronous fuel injection hereinafter.

This program is called by an interruption request to execute the program. The throttle valve position $\Theta_{TH}$ is read in step 601. Then, the difference $\Delta\Theta_{TH}$ between a throttle valve position $\Theta_{THn-1}$ read in the preceding loop and a throttle valve position $\Theta_{THn}$, namely, a throttle valve position variation, is calculated in step 602. In step 603, a check is made to decide whether or not the count $t_c$ of a down counter (described below) is zero or below zero. When the decision in step 603 is YES, a flag nF is set for "0" and, when NO, step 604 is skipped and the routine jumps to step 605.

The down counter is used for inhibiting accelerating incremental fuel supply for a predetermined period subsequent to one cycle or a series of accelerating incremental fuel supply corrections. In the initial state, the flag nF=0. The flag nF is changed from "0" to "1" when accelerating incremental fuel supply correction is carried out by asynchronous fuel injection.

In step 605, a check is made to decide whether or not an asynchronous fuel injection process is bypassed, namely, whether or not the accelerating incremental fuel supply process is to be inhibited. Since the nF flag is set for "1" when accelerating incremental fuel supply correction is carried out, the decision to step 605 is made with reference to the nF flag. When the asynchronous fuel injection process is bypassed, the decision in step 605 is YES and, when not, the decision is NO, and then step 606 and the subsequent steps are executed.

Figure 7A:
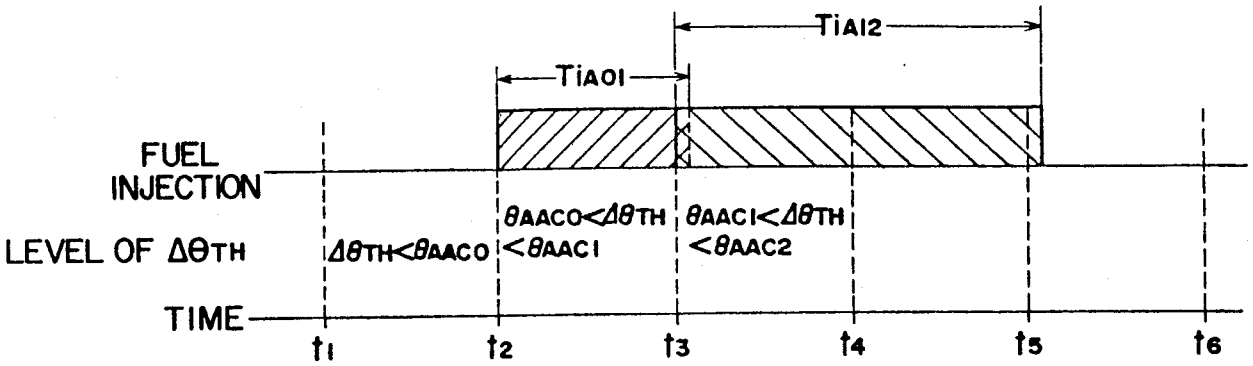
FIG. 7(*a*) and 7(*b*) are time charts illustrating in part the asynchronous fuel injection of the controller of FIG. 6.
Figure 7B:
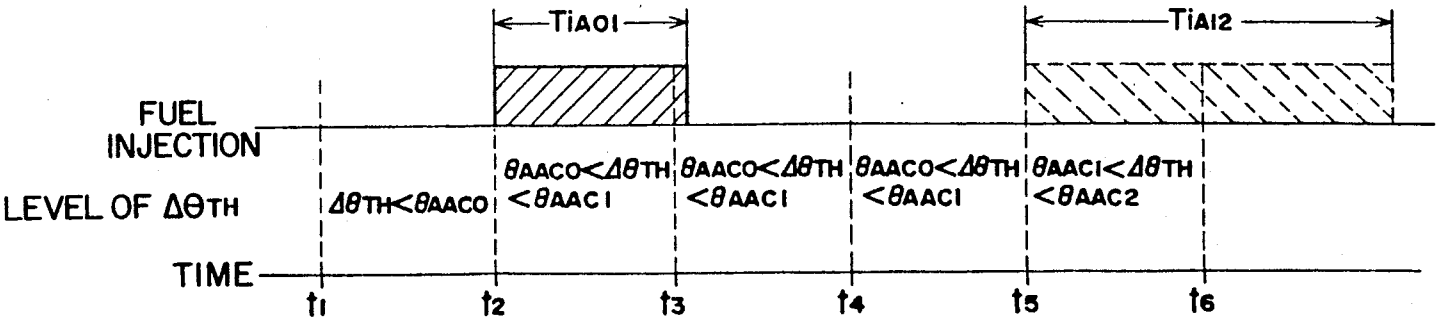

In step 606, a check is made to decide whether or not the throttle valve position variation $\Delta\Theta_{TH}$ is greater than a predetermined criterion $\Theta_{AACO}$ (for example, 4 bits per 4 msec, in which 1 bit=0.39) to detect whether or not the engine 1 is in a predetermined accelerating state. When the decision in step 606 is NO, namely, when $\Delta\Theta_{TH}$ is less than $\Theta_{AACO}$, the accelerating incremental fuel supply time $Ti_A$ is set at "0" in step 607. Then, the $Ti_A$ setting circuit 64 is set for the $Ti_A$ in step 608, the Ti counter 65 is started in step 609, and the program in the periodic interruption mode is ended. That is, in this case, accelerating incremental fuel supply correction is not carried out, and hence asynchronous fuel injection for a time interval between time $t_1$ and time $t_2$ based on the $Ti_A$ is not performed as shown in FIGS. 7(*a*) and 7(*b*). The value $\Theta_{AACO}$ is a guard value to inhibit accelerating incremental fuel supply correction when variations in throttle valve position are below a fixed level. This guard value avoids unnecessary incremental fuel supply attributable to a small spontaneous variation in throttle valve position.

When the decision in step 606 is YES, namely, when $\Delta\Theta_{TH} > \Theta_{AACO}$, the flag nF is set for "1" in step 610. An accelerating incremental fuel supply time $Ti_Aij$ corresponding to an accelerating level $\Delta\Theta_{AAC}$ is selected from a $Ti_A$ table in step 611 for appropriate accelerating incremental fuel supply correction to an accelerating mode to be started in this loop. Then the accelerating incremental fuel supply time $Ti_A$ is set at the time $Ti_{Aij}$ retrieved from the $Ti_A$ table in step 612.

Figure 8:
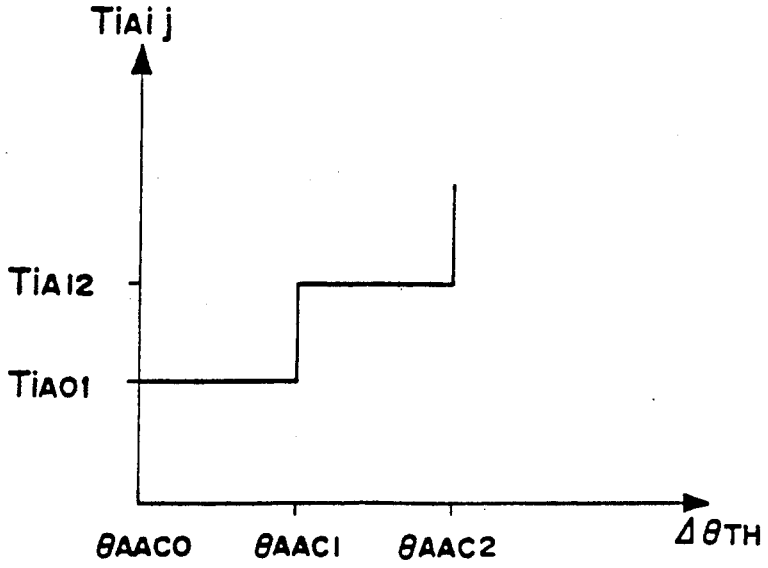
FIG. 8 is a graph showing the relation between the variation $\Delta\Theta_{TH}$ of throttle valve position and accelerating incremental fuel supply time $Ti_A$ in the controller of FIG. 6.

FIG. 8 shows the $Ti_A$ table, by way of example, for use in steps 611 and 612. In the $Ti_A$ table, the accelerating incremental fuel supply time is decided stepwise. When the variation $\Delta\Theta_{TH}$ in throttle valve position is above the criterion $\Theta_{AACO}$ (the guard value) and less than a predetermined first accelerating level criterion $\Theta_{AAC1}$ (for example, 8 bits per 4 msec, where 1 bit=0.39°), namely, $\Theta_{AACO}<\Theta_{TH}<\Theta_{AAC1}$, a predetermined first accelerating incremental fuel supply time $Ti_{A01}$ (for example, 4.2 msec) is selected. When the variation $\Delta\Theta_{TH}$ is above the first accelerating level criterion $\Theta_{AAC1}$and less than a predetermined second accelerating level criterion $\Theta_{AAC2}$ (for example, 16 bits per 4 msec, where 1 bit=0.39°), namely, when $\Theta_{AAC1}<\Delta\Theta_{TH}<\Theta_{AAC2}$, a predetermined second accelerating incremental fuel supply time $Ti_{A12}$ (for example, 8.2 msec), which is greater than the first accelerating incremental fuel supply time $Ti_{A01}$, is selected.

After the value retrieved from the $Ti_A$ table has been set as the $Ti_A$, in step 613, the down counter for timing a fixed time (for example, 8.2 msec) is set for the fixed time as an initial value and the down counter is started. On the other hand, in step 608, the $Ti_A$ setting circuit 64 is set for the accelerating incremental fuel supply time $Ti_A$ set in step 612 and the $Ti_A$ counter 65 is started to actuate the fuel injection valve 11 for asynchronous fuel injection, and the program is ended.

Thus, when the variation $\Delta\Theta_{TH}$ of throttle valve position exceeds $\Theta_{AACO}$, the fuel supply system is controlled in the manner shown in FIGS. 7(*a*) and 7(*b*) for asynchronous fuel injection for a time according to the accelerating level. For example, when $\Theta_{AACO}<\Delta\Theta_{TH}\Theta_{AAC1}$, fuel is injected for the time $Ti_{A01}$ for accelerating incremental fuel supply correction.

The down counter serves as a bypass timer for inhibiting accelerating incremental fuel supply correction in the subsequent loop by interrupting the subroutine in step 605, namely, for skipping steps 606 and 610 to 613, for a fixed time once accelerating incremental fuel supply correction is implemented. In this embodiment, the down counter is started for timing at the start of accelerating fuel injection and the consequence of accelerating fuel injection is monitored in the subsequent loop.

In the subsequent periodic interruption, a check is made from the count $t_c$ of the down counter to decide whether or not a fixed time has elapsed after the start of timing operation. Upon the decrement of the down counter to zero, the flag nF is reset for "0" in step 604 to enable subsequent accelerating incremental fuel supply correction after the elapse of the fixed time. However, since the decision in 603 is NO and step 604 is skipped before the elapse of the fixed time, the routine goes to step 605 without resetting the flag nF in step 604. Consequently, the routine goes from step 605 to step 614.

Accordingly, once accelerating incremental fuel supply correction is implemented, further accelerating incremental fuel supply correction is inhibited for a fixed time period and the fuel supply system is locked in an inhibited state. Consequently, unnecessary accelerating incremental fuel supply correction is avoided even if accidental variation in throttle valve position (e.g., noise) which is likely when the rider's hand gripping the throttle grip of the motorcycle vibrates.

When the routine goes from step 605 to step 614, a check is made to decide whether or not the variation $\Theta_{TH}$calculated in the present loop is smaller than a predetermined negative criterion $\beta 1$ (for example, 2 bits per 4 msec, where 1 bit=0.39°) to see if the variation $\Delta\Theta_{TH}$ in throttle valve position from the preceding throttle valve position is a negative value, namely, if the throttle valve is operated toward the closed position.

When the decision in step 614 is YES, namely, when $\Delta\Theta_{TH}<\epsilon 1$, the bypass timer is reset in step 615, even if the count $t_c$ of the down counter has not yet reached "0", namely, even if the bypass timer is in operation and the fixed time has not elapsed from the start of timing operation. At the same time, the accelerating incremental fuel supply time $Ti_A$ is returned forcibly to "0" in step 616, the flag nF is reset for "0" in step 617, steps 608 and 609 are executed, and then the program is ended.

Thus, steps 615 through 617 are executed to cancel accelerating incremental fuel supply correction inhibition even during the accelerating incremental fuel supply correction inhibiting period when the throttle valve is operated toward the closed position and $\Delta\Theta_{TH}<\Delta 1$. Thus, once the throttle valve is operated toward the closed position subsequent to acceleration, the accelerating incremental fuel supply correction inhibition is cancelled. Hence it is possible to implement acceleration immediately after deceleration and it is possible to effect accelerating incremental fuel supply correction in the subsequent periodic interruption for the execution of the program. Consequently, the rapid acceleration performance is improved and the control operation for accelerating incremental fuel supply correction is carried out without delay. In contrast, the control operation is delayed when fuel injection for accelerating incremental fuel supply correction is inhibited indiscriminately for a fixed time period. Accordingly, this mode of accelerating incremental fuel supply correction is suitable for accelerating incremental fuel supply control for vehicles, such as motorcycles, in which rapid acceleration performance is essential. The present fuel supply controller is able to respond quickly to frequent throttle valve opening and closing operation when applied to a motorcycle wherein the throttle valve may be forcibly closed by turning the throttle grip.

When the decision in step 614 is NO, namely, when $\Delta\Theta_{TH}>\epsilon 1$, the asynchronous fuel injection rate is changed through the following procedure. In the asynchronous fuel injection inhibiting period, a check is made in step 618 to decide whether or not the acceleration level has risen. The decision in step 618 is made through the comparison of the variation $\Delta\Theta_{TH}$ with the first criterion $\Theta_{AAC1}$, the second criterion $\Theta_{AAC2}$ and the variation determined in the preceding loop to check if the variable $\Delta\Theta_{TH}$ determined in the present loop is in a higher range (FIGS. 7(*a*) and 7(*b*)).

When the decision in step 618 is YES, a check is made in step 619 to decide if the flag nF is "1". When the decision in step 619 is YES, the routine goes to step 606 for the subsequent accelerating incremental fuel supply correction. When both the decisions in steps 618 and 619 ar NO, the flag nF is reset for "0", steps 608 and 609 are executed, and then the program is ended.

In the event that $\Theta_{AACO}<\Delta\Theta_{TH}<\Theta_{AAC1}$ in a time period between $t_2$ and $t_3$, and $\Theta_{AAC1}<\Delta\Theta_{TH}<\Theta_{AAC2}$ in a time period between $t_3$ and $t_4$ as shown in FIG. 7(*a*), it is then decided that a series of accelerating operations are performed and the fuel injection rate is changed. That is, the accelerating level is raised continuously, a new accelerating incremental fuel supply time $Ti_A$ according to the present variation $\Delta\Theta_{TH}$ is determined, and then asynchronous fuel injection is continued for a time $Ti_{A12}$ from the time $t_3$ (steps 606, 610 through 613, 608 and 609).

The fuel injection rate is changed by the foregoing procedure for the following reasons. Primarily, once fuel is injected for accelerating incremental fuel supply correction, further accelerating incremental fuel supply correction is inhibited for the subsequent fixed time. The inhibition is then cancelled forcibly under a particular condition in which the throttle valve is operated toward the closed position during the period of accelerating incremental fuel supply correction inhibiting period. However, when the fuel injection rate is not increased according to the continuous variation of the variation $\Delta\Theta_{TH}$ during the accelerating incremental fuel supply correction inhibiting period, it is impossible to supply fuel properly for the continuous rise of the accelerating level. That is, insufficient fuel is supplied and the accelerating performance of the engine deteriorates. Continuous increase of the variation $\Delta\Theta_{TH}$ is considered to have resulted from a series of accelerating operations and the fuel injection rate is changed sequentially for appropriate fuel supply control. Step 613 is executed to change the fuel injection rate. The down counter is cleared and starts counting operation every time the step 613 is executed. Therefore, in the case of FIG. 7(*a*), timing operation for timing the fixed time period is started again at time $t_3$.

On the other hand, when the increase of the difference $\Theta$TH is discontinuous as shown in FIG. 7(*b*), the foregoing operation for changing the fuel injection rate is inhibits accelerating incremental fuel supply correction for the fixed time period. That is, when the acceleration level does not rise in the periods between $t_3$ and $t_4$ and between $t_3$ and $t_5$ (even if accelerating fuel injection is performed from time $t_2$ for the accelerating incremental fuel supply time $Ti_{A01}$), the variation of the acceleration level is discontinuous even if $\Theta_{AAC1} < \Delta\Theta_{TH} < \Theta_{AAC2}$ in a period between Hence fuel injection is inhibited for the period $Ti_{A12}$ shaded by broken lines in FIG. 7(*b*).

As is apparent from the foregoing description, the fuel supply controller according to the present invention, comprises, in addition to accelerating incremental fuel supply correcting means and accelerating incremental fuel supply correction inhibiting means, inhibition canceling means for cancelling the inhibition of accelerating incremental fuel supply correction when the throttle valve is operated toward the closed position subsequently to acceleration, even before the elapse of the predetermined time period. Accordingly, the inhibition of accelerating incremental fuel supply correction can be forcibly cancelled when the throttle valve is operated toward the closed position subsequent to acceleration. Thus, accelerating incremental fuel supply correction can be implemented even if accelerating operation is implemented immediately after the operation of the throttle valve toward the closed position. This improves the rapid accelerating performance of the engine and avoids delay in the fuel supply control operation in rapidly accelerating the engine.

Figure 9:
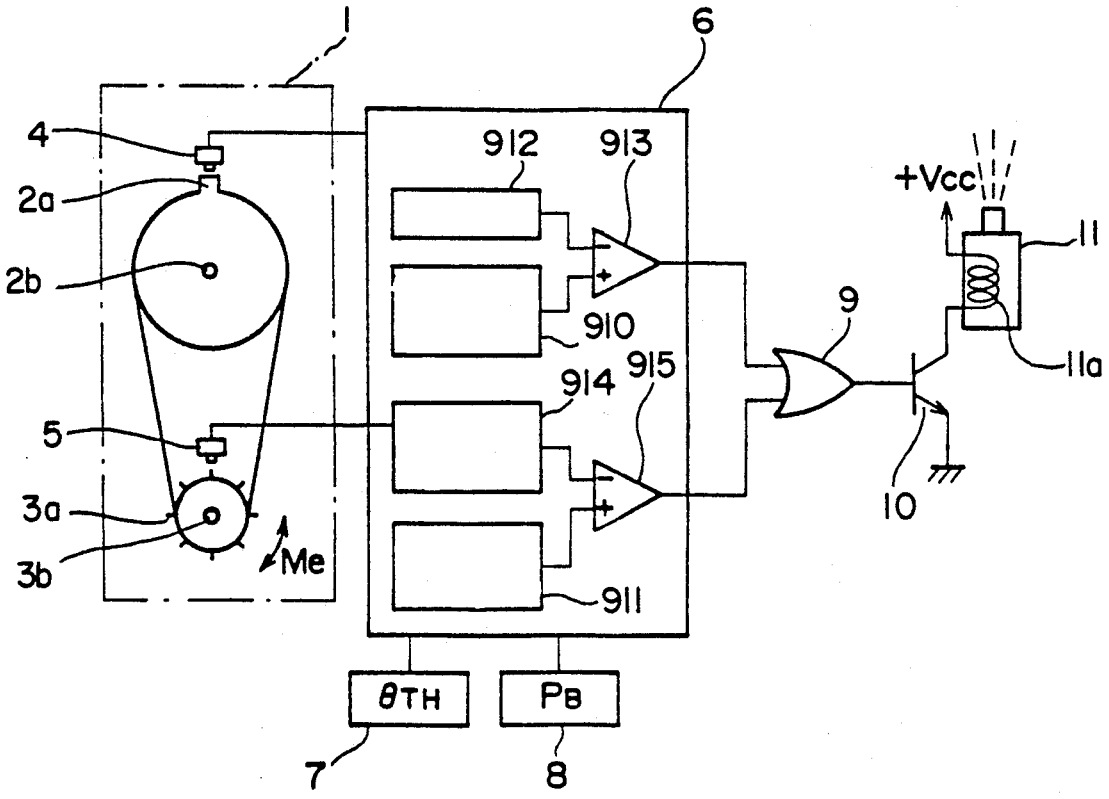
FIG. 9 is a block diagram of a third embodiment of the present fuel supply controller.

FIG. 9 illustrates the fuel supply controller including map discriminating means. As shown therein, the ECU 6 receives output of engine sensors to set a fuel injection rate (i.e., a fuel injection period) at which fuel is to be injected by fuel injection valves 11. A $T_{OUT}$ setting circuit 910 provides a fuel injection period $T_{OUT}$ in which fuel is to be injected while the engine 1 is operating in the normal operating mode. A $Ti_A$ setting circuit 911 provides an accelerating incremental fuel injection period $Ti_A$ in which fuel is to be injected while the engine 1 is operating in an accelerating mode. A comparator 913 compares the output of the $T_{OUT}$ setting circuit 910 and the output of a counter 912. A comparator 915 compares the output of the $Ti_A$ setting circuit 911 and the output of an acceleration counter 914. Specifically, the counter 912 continues to operate from a moment when a fuel injection period $T_{OUT}$ is set until the count thereof coincides with the fuel injection period $T_{OUT}$, and the comparator 913 provides a HIGH signal (hereinafter referred to as "$OUT_1$ signal") while the counter 912 is in operation. The acceleration counter 914 continues to operate from a moment when an accelerating incremental fuel supply period $Ti_A$ is set until the count thereof coincides with the accelerating incremental fuel supply period $Ti_A$, and the comparator 915 provides a HIGH signal (hereinafter referred to as "$OUT_2$ signal") while the acceleration counter 914 is in operation.

The $OUT^1$ signal and the $OUT_2$ signal are applied to an OR gate 9. When the output of the OR gate 9 is HIGH, a transistor 9 is turned on to energize the injector coil 11*a* of the fuel injection valve 11 to open the fuel injection valve 11. Thus, while at least either the $OUT_1$ signal or the $OUT_2$ signal is provided, the corresponding fuel injection valve 11 is opened to supply fuel to the corresponding cylinder of the engine 1.

The ECU 6 comprises map discriminating means which identifies a selected map among a $P_B$-Ne map (first map), namely, a matrix specified by intake manifold pressure $P_B$ and engine speed Ne, and a $\Theta_{TH}$-Ne map (second map), namely, a matrix specified by throttle valve position $\Theta_{TH}$ and engine speed Ne. This is done on the basis of the load condition of the engine 1, namely, a high-load condition or a low-load condition. Accelerating incremental fuel supply means increase the rate of fuel supply to the internal-combustion engine when the internal-combustion engine is operating in a predetermined accelerating mode, only when the map discriminating means identifies the first map as the selected map. (The fuel injection valves 11 and the $Ti_A$ setting circuit 911 are the components of the accelerating incremental fuel supply means.)

Figure 10:
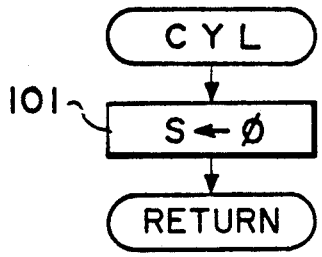
FIGS. 10 and 11 are flowcharts of basic control routines for controlling synchronous fuel injection with the controller of FIG. 9.
Figure 11:
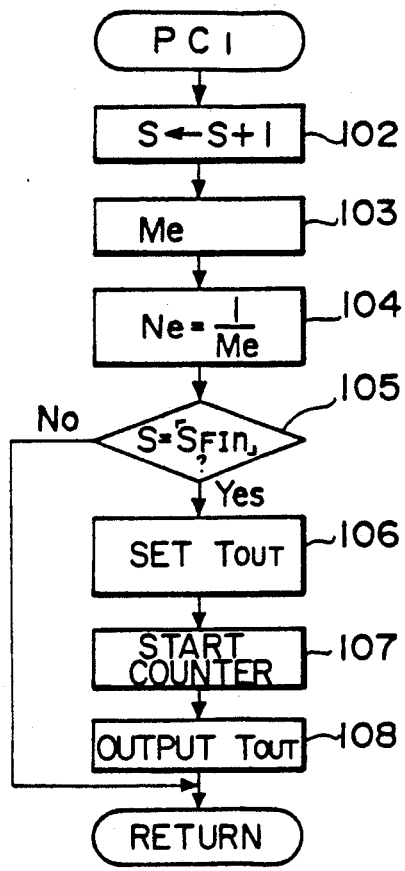
Figure 12:
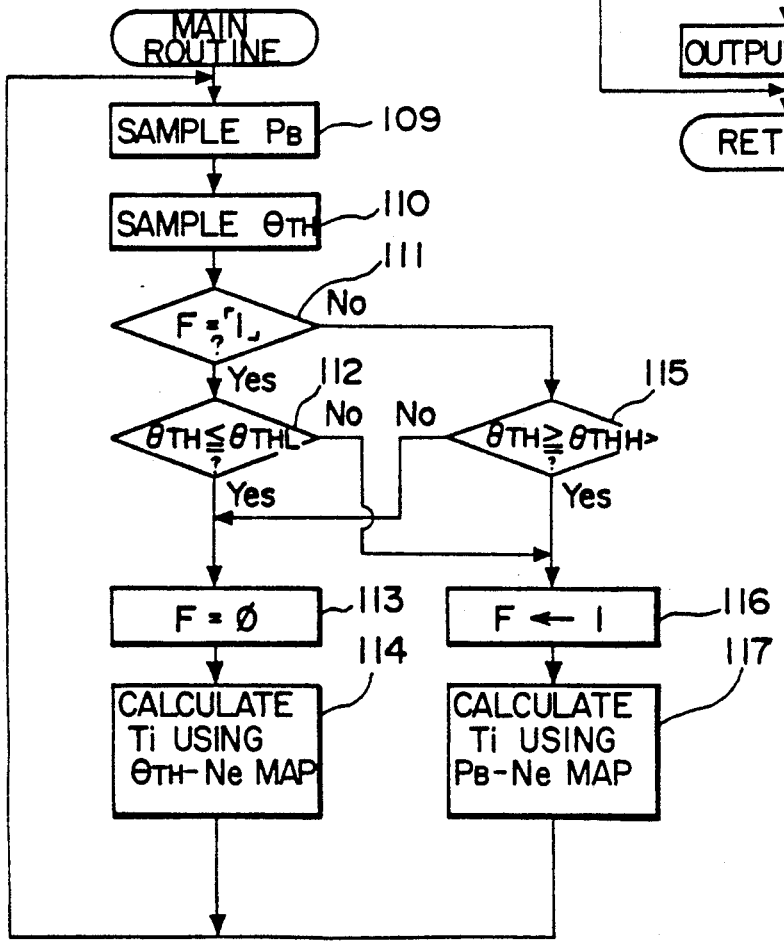
FIG. 12 is a flowchart in part illustrating the procedures for changing over fuel injection period maps for synchronous fuel injection in the controller of FIG. 9.

FIGS. 10, 11 and 12 show control routines for calculating fuel injection period $T_{OUT}$. Basically, these control routines are executed to calculate a fuel injection period for fuel injection synchronous with the $PC_1$ pulse (synchronous fuel injection).

The control routine of FIG. 10 is executed every CYL pulse generation. In step 101, a stage counter, not shown, is reset (the count S of the stage counter is cleared) with every CYL pulse.

Referring to FIG. 11, the count of the stage counter is increased in step 102 after the same has been reset every generation of a $PC_1$ pulse by an increment of "1". In step 103, the time interval between the adjacent stages, namely, the time interval between the successive $PC_1$ pulses, is sampled and engine speed Ne is calculated on the basis of the time interval Me, i.e., the reciprocal of the time interval Me is calculated, in step 104. In step 105, a check is made to decide whether or not the count S of the stage counter coincides with a predetermined count $S_{FIn}$. When the decision in step 105 is YES, a fuel injection period $T_{OUT}$ is set in step 106 for the cylinder represented by the count $S_{FIn}$ on the basis of a basic fuel injection period Ti which has been calculated previously through the routine shown in FIG. 12. Step 105 is executed to determine the cylinder for which the control routine of FIG. 11 is to be executed and to select the fuel injection valve corresponding to the same cylinder. That is, the predetermined count $S_{FIn}$ is a value set specifically for each cylinder.

After the fuel injection period $T_{OUT}$ has been set in step 106, the counter 12 is started in step 107. Synchronous fuel injection corresponding to the output of the $T_{OUT}$ setting circuit 910 is performed in step 108 while the counter 912 counts the $PC_1$ pulses for a time corresponding to the fuel injection period $T_{OUT}$, and then the program is ended.

When the decision in step 105 is NO, namely, when the count of the stage counter is less than the predetermined count $S_{FIn}$, none of the cylinders is at a stage for fuel injection, and hence the program is ended.

Synchronous fuel injection is controlled by a routine shown in FIG. 12. First, the intake manifold pressure $P_B$ is sampled in step 109. Then the throttle valve position $\Theta_{TH}$ is sampled in step 110. A check is made in step 111 to decide whether or not a flag F is "1", namely, whether or not the operating mode of the engine 1 is in the $P_B$-Ne control range. This is performed to determine, with reference to the magnitude of a value representing throttle valve position $\Theta_{TH}$, whether the engine 1 is in a low-load operating mode (for example, an operating mode in which the engine 1 operates at a low engine speed) in which synchronous fuel injection is controlled by using the $P_B$-Ne map, or whether the engine 1 is in a high-load mode (for example, an operating mode in which the engine 1 operates at a high engine speed) in which synchronous fuel injection is controlled by using the $\Theta_{TH}$-Ne map.

If the decision in step 111 is YES, a query is made in step 112 to see if the throttle valve position $\Theta_{TH}$ is not greater than a predetermined throttle valve position $\Theta_{THL}$. When the response in step 112 is YES, namely, when $\Theta_{TH} \leqq \Theta_{THL}$, the flag F is set for "0" in step 113, and then a basic fuel injection period Ti is calculated in step 114 by using the $\Theta_{TH}$-Ne map for synchronous fuel injection in the $\Theta_{TH}$-Ne control range. After the basic fuel injection period Ti for the present control cycle has been calculated, the routine returns to step 109 to execute the loop to calculate a basic fuel injection period for the next control cycle.

When the decision in step 111 is NO, a query is made in step 115 if the throttle valve position $\Theta_{TH}$ is not less than a predetermined throttle valve position $\Theta_{THH}$, which is greater than the predetermined throttle valve position $\Theta_{THL}$. When the response in step 115 is YES, namely, when $\Theta_{TH} \geqq \Theta_{THH}$, the flag F is set for "1" in step 116, and then a basic fuel injection period Ti is calculated in step 117 by using the $P_B$-Ne map for synchronous fuel injection in the $P_B$-Ne control range. After the basic fuel injection period Ti for the present control cycle has been calculated, the routine returns to step 109 to execute the loop to calculate a basic fuel injection period for the next control cycle.

When the response in step 112 is NO, namely, when synchronous fuel injection is being implemented in the $P_B$-Ne control range and the throttle valve position $\Theta_{TH}$ is above the predetermined throttle valve position $\Theta_{THL}$, the routine proceeds to step 116 to continue synchronous fuel injection in the $P_B$-Ne control range.

On the other hand, when the response in step 115 is NO, namely, synchronous fuel injection in the $P_B$-Ne control range is not implemented and the throttle valve position $\Theta_{TH}$ is less than the predetermined throttle valve position $\Theta_{THL}$, the routine proceeds to step 113 to continue the calculation of the basic fuel injection period Ti by using the $\Theta_{TH}$-Ne map. Thus, the manner of setting the flag F in a case where the throttle valve position $\Theta_{TH}$ varies from a small value to a large value and the manner of setting the flag F in a case where the throttle valve position $\Theta_{TH}$ varies from a large value to a small value are different from each other (the manner of setting the flag F has hysteretic characteristics). This avoids unstable control of fuel injection attributable to the changeover of the maps in response to a slight variation of the throttle valve position $\Theta_{TH}$.

Figure 13:
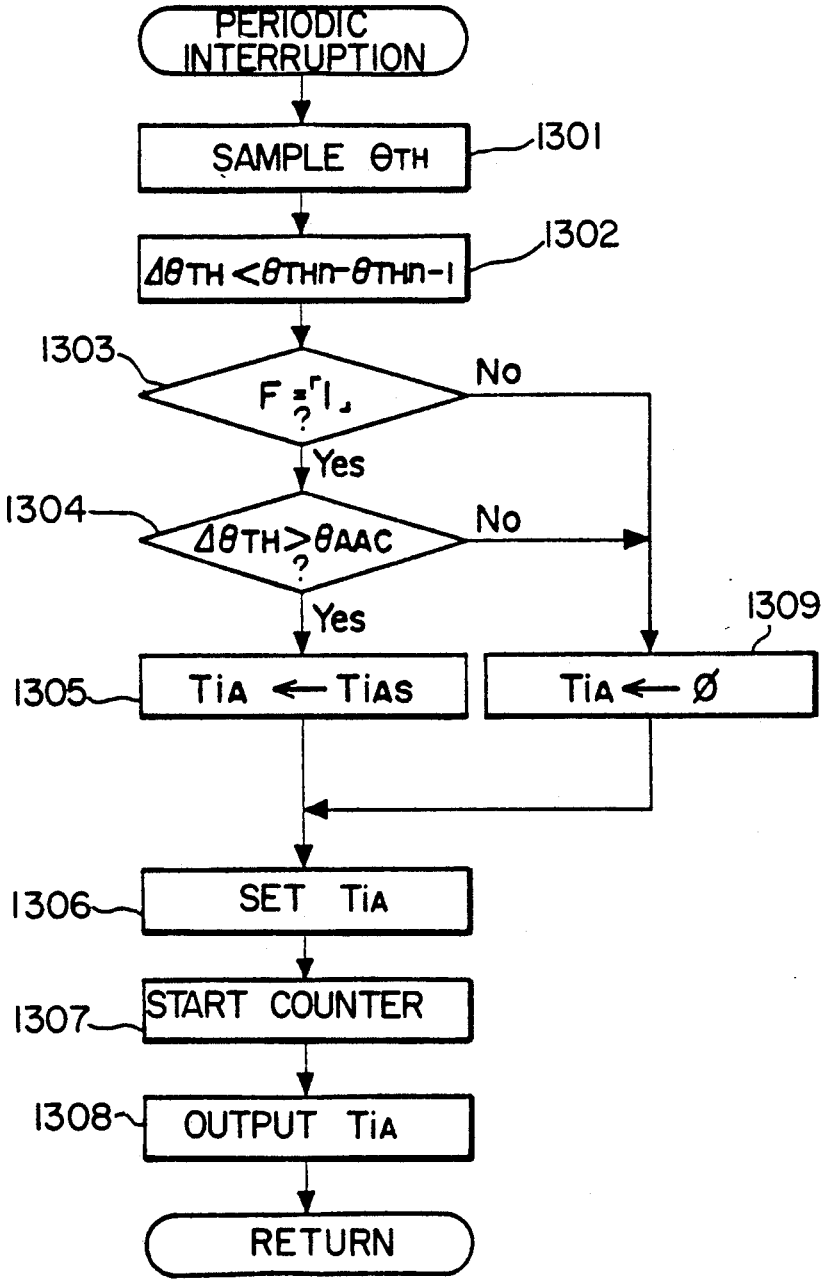
FIG. 13 is a flowchart of a fuel supply control routine for controlling asynchronous fuel injection in the controller of FIG. 9.

FIG. 13 shows an interruption routine for setting the accelerating incremental fuel supply period $Ti_A$ and fuel injection for the accelerating incremental fuel supply period $Ti_A$. This routine is repeated periodically (for example, every 4 msec) and asynchronously with the $PC_1$ pulse (asynchronous fuel injection). Asynchronous fuel injection occurs, for example, simultaneously for all the cylinders.

Referring to FIG. 13, a throttle valve position $\Theta_{THn}$ is sampled in step 1301. In step 1302, a throttle valve position variation $\Delta\Theta_{TH}$, namely, the difference between the present throttle valve position $\Theta_{THn}$ and a throttle valve position $\Theta_{THn-1}$ sampled in the preceding control cycle, is calculated.

In step 1303, a query is made to see if the flag F is set for "1", namely, if synchronous fuel injection in the $P_B$-Ne control range is being performed. If the response in step 1303 is YES, namely, if synchronous fuel injection is controlled in the $P_B$-Ne control range, the routine goes to step 1304. In step 1304, a check is made to decide whether or not the throttle valve position variation $\Delta\Theta_{TH}$ is above a predetermined value $\Theta_{AAC}$, namely, whether or not the engine 1 is in a predetermined accelerating mode. When the decision in step 1304 is YES, a predetermined period $Ti_{As}$ (for example, 6 msec) is set as the accelerating incremental fuel supply period $Ti_A$ in step 1305.

The set accelerating incremental fuel supply period $Ti_A$ is given to the $Ti_A$ setting circuit 911 in step 1306, the acceleration counter 914 is started in step 1307, the fuel injection valves 11 are actuated for asynchronous fuel injection in step 1308, and then the program is ended.

When the decision in step 1303 is NO, namely, when the fuel injection period is not controlled in the $P_B$-Ne control range, the accelerating incremental fuel supply period $Ti_A$ is set for "0" in step 1309. That is, in this case, fuel injection is controlled in the $\Theta_{TH}$-Ne range and the engine is operating in the high-load operating mode, and hence control for acceleration is not necessary. Also in a state where the decision in step 1304 is NO, namely, when the throttle valve position variation $\Delta\Theta_{TH}$ is below the set value $\Theta_{AAC}$, control for acceleration is not necessary, and hence the accelerating incremental fuel supply period $Ti_A$ is set for "0" in step 1309. Thus, asynchronous fuel injection is performed to supply fuel to the engine at an increased fuel supply rate for acceleration only during synchronous fuel injection in the $P_B$-Ne control range.

Figure 14:
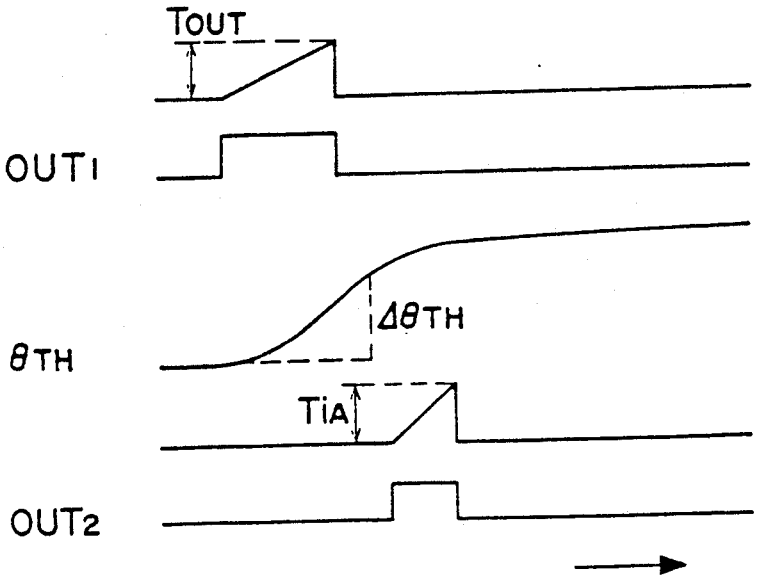
FIG. 14 is a time chart showing the relation between basic fuel injection period and accelerating incremental fuel injection period in the controller of FIG. 9.

FIG. 14 shows the time relation between the fuel injection period $T_{OUT}$ and the accelerating incremental fuel supply period $Ti_A$ by way of example. During a period where the $OUT_1$ signal is being provided, fuel injection is implemented for the fuel injection period $T_{OUT}$ and, upon the detection of significant increase in the throttle valve position $\Theta_{TH}$ ($\Delta\Theta_{TH} > \Theta_{AAC}$), the $OUT_2$ signal is provided to implement fuel injection for the accelerating incremental fuel supply period $Ti_A$.

As is apparent from the foregoing description the present fuel supply controller implements fuel supply to an internal-combustion engine by selectively using a first map specified by the intake manifold pressure and engine speed of the engine as parameters, and a second map specified by the throttle valve position and engine speed as parameters. The controller comprises map discriminating means for determining the selected map among the first and second maps. Accelerating incremental fuel supply means increases the fuel supply rate while the internal-combustion engine is in a predetermined accelerating mode only when the map discriminating means identifies the selected map as the first map. Accordingly, in an internal-combustion engine mounted on a motorcycle (in which the low-speed operating mode of the engine particularly requiring incremental fuel supply corresponds to a fuel supply mode in which synchronous fuel injection is controlled on the basis of the first map) asynchronous fuel injection is implemented only when the engine is accelerated. Consequently, delay in fuel supply control based on the first map when the throttle valve position varies entailing variation in the intake manifold pressure can be compensated. As a result, delay in fuel supply control immediately after the change of the selected map from the second map to the first map, which occurs in the conventional fuel supply controller, is obviated. Furthermore, since asynchronous fuel injection is unnecessary while the engine is operating in the high-load range, fuel economy is improved and the fuel supply control program is simplified.

Figure 15:
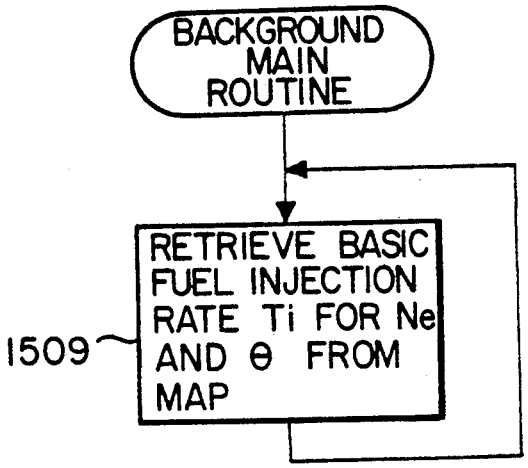
FIG. 15 is a flowchart in part illustrating a procedure for setting a fuel injection period for asynchronous fuel injection in the controller of FIG. 16.

The routine shown in FIG. 15 for setting the basic fuel injection period Ti is executed in the background processing mode to retrieve the basic fuel injection period Ti corresponding to an engine speed Ne and a throttle valve position $\Theta_{TH}$ from a matrix memory (map) using the engine speed Ne and the throttle valve position $\Theta_{TH}$ as parameters (step 1509). The routine shown in FIG. 15 is executed repetitively.

Figure 16:
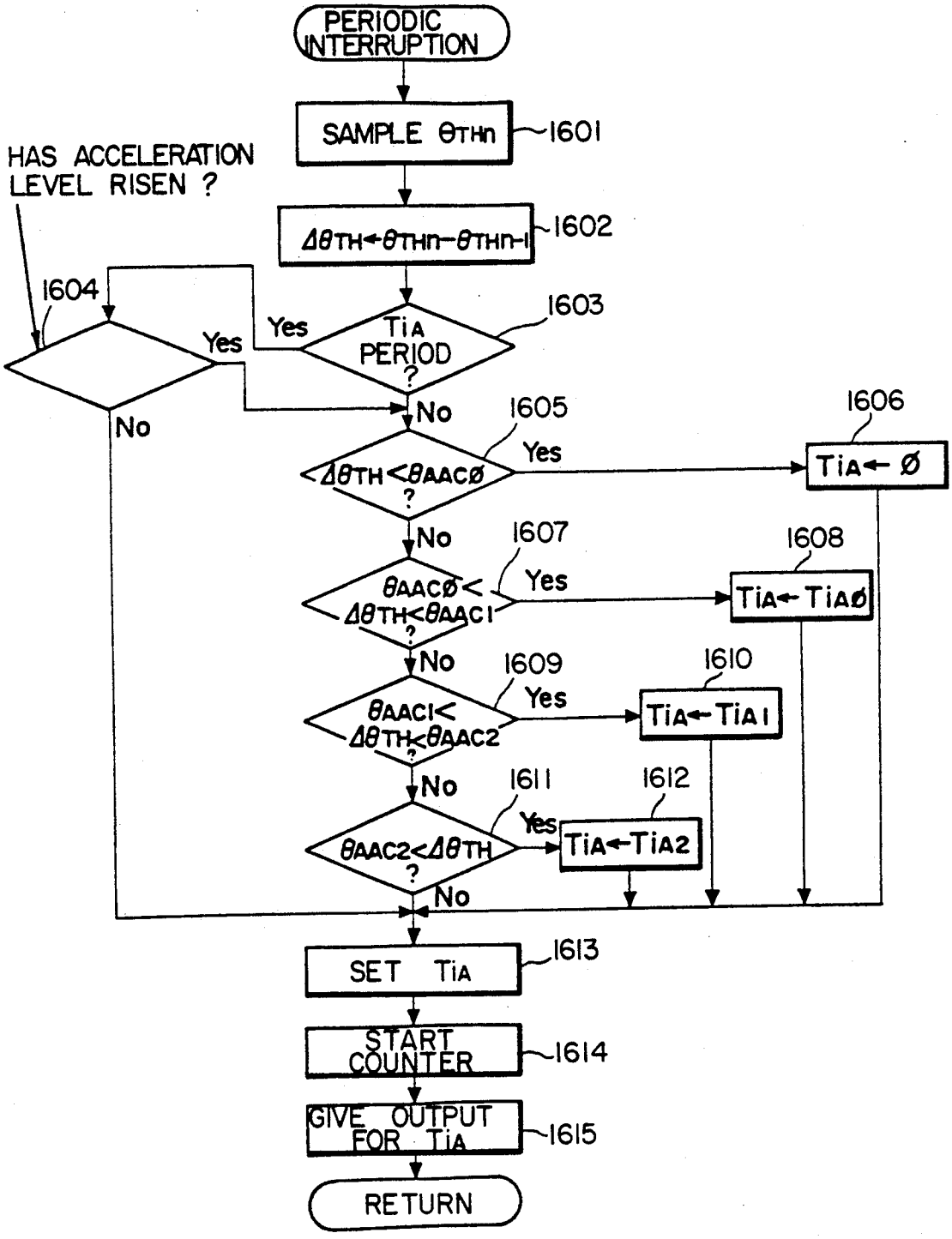
FIG. 16 is a flowchart of a control routine for asynchronous fuel injection in a fourth embodiment of the fuel controller of the invention.

FIG. 16 shows an interruption subroutine for setting the accelerating incremental fuel injection period $Ti_A$ and for performing fuel injection for the accelerating incremental fuel injection period $Ti_A$. This interruption subroutine is executed periodically, for example, every 4 msec, asynchronously with the $PC_1$ pulse (asynchronous fuel injection). Simultaneous asynchronous fuel injection is performed for all the cylinders.

Referring to FIG. 16, a throttle valve position $\Theta_{THn}$ is sampled in step 1601. In step 1602, a throttle valve position variation $\Delta\Theta_{TH}$, namely, the difference between the throttle valve position $\Theta_{THn}$ sampled in the present sampling cycle and a throttle valve position $\Theta_{THn-1}$ sampled in the preceding sampling cycle, is calculated, and then the routine goes to step 1603.

In step 1603, a check is made to decide whether or not asynchronous fuel injection is in process, namely, whether or not the $Ti_A$ setting circuit 911 is providing an asynchronous fuel injection control signal for the accelerating incremental fuel injection period $Ti_A$. When the decision in step 1603 is YES, namely, when the asynchronous fuel injection signal is being provided, a check is made in step 1604 to decide whether or not the rate of acceleration of the engine 1 is increasing continuously, namely, whether or not the accelerating level has risen.

The accelerating level is expressed by the following four modes of acceleration.

| | |
|---|---|
| Fixed accelerating mode | $\Delta\Theta_{TH} < \Theta_{AACO}$ |
| Accelerating mode 0 | $\Theta_{AACO} < \Delta\Theta_{TH} < \Theta_{AAC1}$ |
| Accelerating mode 1 | $\Theta_{AAC1} < \Delta\Theta_{TH} < \Theta_{AAC2}$ |
| Accelerating mode 2 | $\Theta_{AAC2} < \Delta\Theta_{TH}$ |

Figure 17:
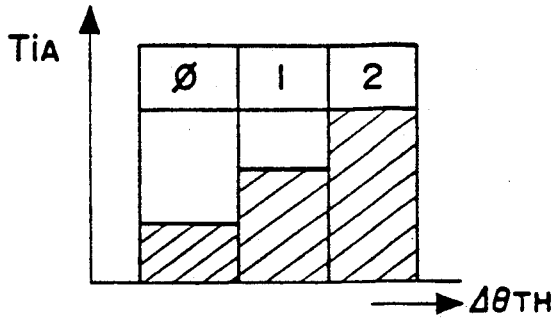
FIG. 17 is a graph showing the relation between throttle valve position and accelerating incremental fuel injection rate in the embodiment of FIG. 16.

FIG. 17 shows the relation between the acceleration level and the accelerating incremental fuel injection period $Ti_A$ for asynchronous fuel injection. The accelerating incremental fuel injection period $Ti_A$ varies stepwise according to the throttle valve position variation $\Delta\Theta_{TH}$, namely, the accelerating incremental fuel injection period $Ti_A$ dependent on the accelerating modes, i.e., the fixed accelerating mode, the accelerating mode 0, the accelerating mode 1 and the accelerating mode 2.

When the decision in step 1604 is YES, namely, when the rate of acceleration is increasing continuously, a check is made in step 1605 to decide which accelerating mode corresponds to the throttle valve position variation $\Delta\Theta_{TH}$. Then the accelerating incremental fuel injection period $Ti_A$ for asynchronous fuel injection is selected according to the decision in step 1605. That is, a check is made in step 1605 to decide whether or not the engine is in the fixed accelerating mode. When the decision in step 1605 is YES, the accelerating incremental fuel injection period $Ti_A$ is set for "0" in step 1606 and, when NO, a check is made in step 1607 to decide whether or not the engine is in the accelerating mode 0. When the decision in step 1607 is YES, an accelerating incremental fuel injection period $Ti_{A0}$, for example, 2 msec, is set in step 1608 and, when NO, a check is made in step 1609 to decide whether or not the engine is in the accelerating mode 1. When the decision in step 1609 is YES, a $Ti_{A1}$, for example, 4 msec, is set in step 1610 and, when NO, a check is made in step 1611 to decide whether or not the engine is in the accelerating mode 2. When the decision in step 1611 is YES, a $Ti_{A2}$, for example, 8 msec, is set in step 1612. The $Ti_A$ setting circuit 911 is set for the set accelerating incremental fuel injection period $Ti_A$ in step 1613, the acceleration counter 914 is started simultaneously in step 1614, asynchronous fuel injection is performed according to the output of the $Ti_A$ setting circuit 911 in step 1615, and then the program is ended.

When the decision in step 1603 is NO, namely, when asynchronous fuel injection is not in process, the routine goes to step 1605 to discriminate the subsequent accelerating level. The same accelerating incremental fuel injection period setting procedure is executed to set an accelerating incremental fuel injection period $Ti_A$ suitable for the accelerating level. Asynchronous fuel injection is performed for the accelerating incremental fuel injection period $Ti_A$, and the program is ended.

When the decision in step 1604 is NO, namely, when the accelerating incremental fuel supply rate need not be increased, the routine jumps to step 1613 to perform asynchronous fuel injection for an accelerating incremental fuel injection period $Ti_A$ selected in the preceding control cycle.

Figure 18:
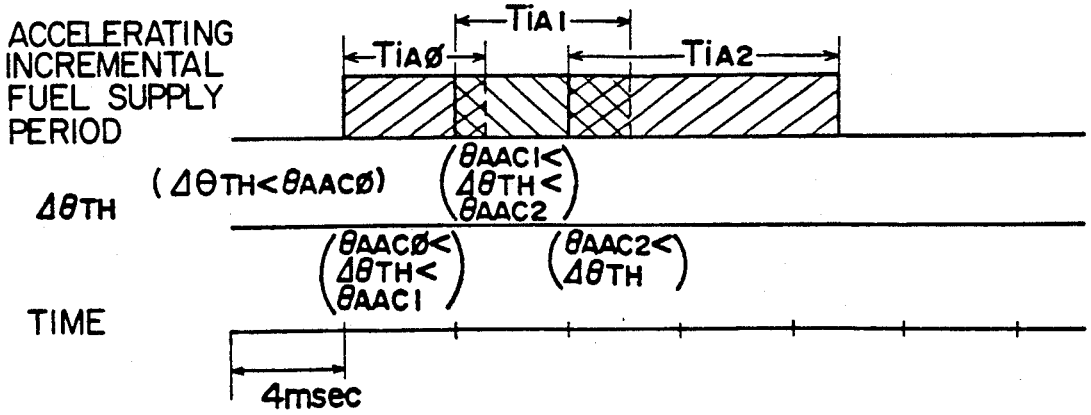
FIG. 18 is a diagram showing the relation between the variation of throttle valve position and the variation of accelerating incremental fuel injection period over time in the embodiment of FIG. 16.

As shown in FIG. 18, accelerating incremental fuel injection is performed periodically at predetermined time intervals, for example, 4 msec, monitoring the throttle valve position variation $\Theta_{TH}$ for incremental fuel injection by the fuel injection valves 1 while the accelerating mode continues. Since accelerating incremental fuel supply periods $Ti_A$ respectively corresponding to $Ti_{A0}$, $Ti_{A1}$ and $Ti_{A2}$ are greater than the fixed period, namely, since the end portion of $Ti_{A0}$ and the starting portion of $Ti_{A1}$, and the end portion of $Ti_{A1}$ and the starting portion of $Ti_{A2}$ overlap each other while the rate of acceleration increases, the opening period of the fuel injection valves 11 is extended.

Although simultaneous asynchronous fuel injection is performed for all the cylinders in this embodiment, asynchronous fuel injection may be performed only for the cylinder in the suction stroke to economize fuel consumption.

As is apparent from the foregoing description, the fuel supply controller comprises accelerating mode discriminating means, and accelerating incremental fuel supply means for supplying fuel to the internal-combustion engine at an accelerating incremental fuel supply rate according to the output of the accelerating mode discriminating means. This increases the accelerating incremental fuel supply rate when the accelerating level of the internal-combustion engine rises during fuel supply at the accelerating incremental fuel supply rate. Therefore, sufficient fuel is injected into the cylinders and fuel supply rate is increased continuously even when the rate of acceleration of the engine rises continuously. Consequently, the engine can smoothly accelerate and avoid irregular operation.

What is claimed is:

1. A fuel supply controller comprising:

a synchronous injection time setting circuit having a map and means for selecting a synchronous injection time from said map depending upon instantaneous engine operating parameters;

means for measuring engine speed;

means for determining variation in throttle valve position;

a synchronous injection time setting circuit for setting a fuel injection time based at least on steady state engine speed;

an asynchronous injection time setting circuit, connected to said means for determining variation in throttle valve position and said means for measuring engine speed which selects a predetermined and fixed asynchronous injection time from a range of asynchronous injection times which decrease with increasing engine speed; and means for determining a logical sum connected to said synchronous and asynchronous injection time setting circuits said asynchronous injection time setting circuit thereby avoiding oversupplying fuel with increasing engine speeds.

2. The apparatus of claim 1 wherein the asynchronous injection time setting circuit selects an asynchronous injection time from a range of 3 discreet asynchronous injection time periods.

3. The apparatus of claim 1 wherein said engine operating parameters are engine speed and throttle valve position.

4. A fuel supply controller for a motorcycle engine having a throttle valve comprising:

accelerating incremental fuel supply correcting means for correcting the duration of fuel injection when the engine is in a predetermined state of acceleration;

inhibiting means for inhibition of fuel supply correction for a predetermined period after initiation of fuel supply correction; and cancelling means for cancelling inhibition of fuel supply correction prior to the elapse of the predetermined period if the throttle valve is moved towards a closed position.

5. A fuel supply controller for an engine comprising an electronic control unit having:

a first fuel injection time map specified by intake manifold pressure and engine speed;

a second fuel injection time map specified by throttle valve position and engine speed;

discriminating means having a hysteresis characteristic which changes map selection depending upon direction of movement of the throttle valve, for selecting between the first and second maps; and accelerating incremental fuel supply means for increasing fuel injection time when the engine is in a predetermined accelerating mode and when said discriminating means has selected the first map.

* * * * *